US005950553A

United States Patent [19]

Bohlinger et al.

[11] Patent Number: 5,950,553

[45] Date of Patent: Sep. 14, 1999

[54] METHOD AND APPARATUS FOR SLIDABLY RETAINING A DRAWSTRING CORD WITHIN A TRIM COVER MATERIAL

[75] Inventors: Raymond Bohlinger, Sterling Heights; Bernard N. Bush, Plymouth, both of Mich.

[73] Assignee: Lear Corporation, Southfield, Mich.

[21] Appl. No.: 08/895,421

[22] Filed: Jul. 16, 1997

[51] Int. Cl.[6] ..... D05B 97/00; B68G 7/05

[52] U.S. Cl. ..... 112/475.08; 112/475.26; 112/436; 297/218.4

[58] Field of Search ..... 112/475.08, 475.26, 112/470.33, 139, 162, 418, 419, 436, 432, 433; 297/452.58, 452.59, 452.6, 452.48, 218.4; 427/387

[56] References Cited

U.S. PATENT DOCUMENTS 726,311 4/1903 Klemm ..... 112/436
4,732,097 3/1988 Guilhem ..... 112/475.26
5,700,870 12/1997 Mueller et al. ..... 427/387 X

*Primary Examiner*—Peter Nerbun
*Attorney, Agent, or Firm*—MacMillan, Sobanski & Todd, LLC

[57] ABSTRACT

An automotive seat assembly comprising a trim cover material having a top surface and a bottom surface with a peripheral edge portion extending along one side thereof. A continuous stitching material passes through and between a number of apertures along the trim cover to form a first seam along the top surface and a second seam along the bottom surface. A drawstring cord is overlaid along the top surface of the trim cover between the first seam and the edge portion. The stitching material loops around a continuous first enclosure material to pull the first enclosure material against the cord and the top surface of the trim cover. Similarly, the stitching material loops around the second enclosure material to pull the second enclosure material against the bottom surface of the trim cover. The first enclosure material loops around the second enclosure material adjacent the edge portion of the trim cover to form a first channel between the edge and the first seam along the top surface to slidably retain the cord against the top surface of the trim cover.

20 Claims, 4 Drawing Sheets

METHOD AND APPARATUS FOR SLIDABLY RETAINING A DRAWSTRING CORD WITHIN A TRIM COVER MATERIAL

TECHNICAL FIELD

The subject invention relates to an automotive seat having a trim cover material with a drawstring cord for retaining the trim cover against the seat. More specifically, the subject invention relates to a means for slidably securing the cord within the trim cover.

BACKGROUND OF THE INVENTION

Automotive seat assemblies typically include a seat frame, a foam cushion, and a trim cover material for covering the cushion and frame. The trim cover may be secured to the seat in a number of ways. Some current methods of attachment include steam heating, chemical bonding, electric heating, mechanical fasteners and/or drawstring fasteners.

The drawstring fasteners typically include a drawstring cord slideably retained within a hollow sheath. The sheath is a long rectangular piece of fabric that is folded over the cord and then sewn together to form a long hollow tube. The sheath is then in turn sewn to the trim cover. The trim cover, along with the sheath and the cord, is wrapped around the cushion and a portion of the frame. The cord is then secured to the frame which tightly secures the cushion and the trim cover to the frame. Specifically, a user pulls on the cord which typically cinches the sheath and tightly secures the trim cover to the seat. These components and this type of seat assembly are well known by those skilled in the art. This current design, however, has a number of deficiencies.

Manufacturing the sheath/cord assembly and then attaching the sheath to the trim cover is time consuming, expensive, and labor intensive. In addition, the cord may not slide easily within the sheath, especially if the sheath is more than a few inches long. The frictional forces created between the cord and the sheath can be difficult to overcome without damaging or deforming the sheath.

Accordingly, there remains a need for an improved drawstring cord design that eliminates the use of a sheath while still allowing the cord to be slidably retained against the trim cover. In addition, the design should substantially minimize any frictional forces created by the cord.

SUMMARY OF THE INVENTION AND ADVANTAGES

An automotive seat assembly comprising a trim cover material having a top surface and a bottom surface. The trim cover has a peripheral edge portion extending along one side thereof. A plurality of interwoven first strands form a continuous first enclosure material and a plurality of interwoven second strands form a continuous second enclosure material. A plurality of spaced apart apertures extend through the top and bottom surfaces near the edge portion of the trim cover. A continuous stitching material passes through each of the apertures. The stitching material also passes between each of the apertures along the top surface and loops around the first enclosure material to pull the first enclosure material against the top surface to form a first seam. Similarly, the stitching material passes between each of the apertures along the bottom surface and loops around the second enclosure material to pull the second enclosure material against the bottom surface to form a second seam. The first enclosure material loops around the second enclosure material adjacent the edge portion of the trim cover to form a first channel between the edge and the first seam along the top surface and a second channel between the edge and the second seam along the bottom surface. A cord is slidably disposed within at least one of the first and second channels for passing the cord along at least one of the top and bottom surfaces of the trim cover.

A method of slidably retaining the cord against the trim cover material comprises the steps of: forming at least one seam along the surface of the trim cover by feeding the continuous stitching material through and between the plurality of apertures in the trim cover; forming at least one channel between the seam and the edge portion of the trim cover by looping the first enclosure material around the second enclosure material adjacent the edge portion of the trim cover; overlaying the cord against a portion of the surface of the trim cover within the channel; and looping the stitching material around the first and second enclosure materials to pull at least one of the first and second enclosure materials against the cord and the trim cover for slidably retaining the cord within the channel and against the trim cover.

Accordingly, the subject invention eliminates the need for a sheath while still having a cord slidably retained against a portion of the trim cover. In addition, the cord can easily slide within the channels formed by the enclosure materials. The frictional forces created between the cord and the enclosure materials is minimized due to a number of openings formed between the weaving enclosure materials.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
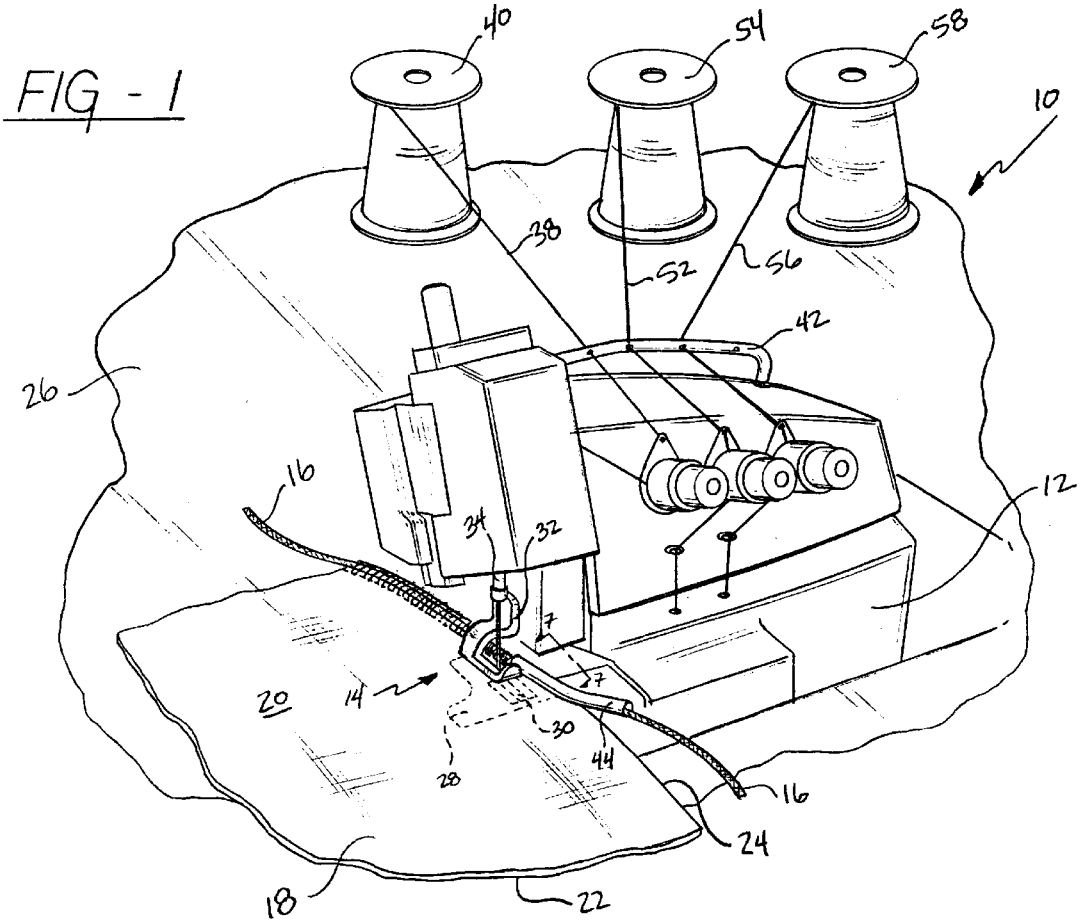
FIG. 1 is a perspective view of a sewing machine assembly incorporating the subject invention.

Referring to the Figures, wherein like numerals indicate like or corresponding parts throughout the several views, a sewing machine assembly is generally shown at 10 in FIG. 1. The sewing machine assembly 10 includes an exterior housing 12 for protecting and concealing a majority of the operating components. The sewing machine assembly 10 also includes a stitching mechanism, generally shown at 14, for performing a desired sewing operation. The specific sewing operation of the subject invention slidably secures a drawstring cord 16 to a trim cover material 18. The trim cover material 18 has a top surface 20 and a bottom surface 22 with a peripheral edge portion 24 extending along one side thereof. The top surface 20 of the trim cover 18 is the interior surface and the bottom surface 22 of the trim cover 18 is the exterior surface. In the preferred embodiment, the drawstring cord 16 is slidably secured to the interior surface of the trim cover 18. The trim cover 18 of the subject invention may be of any suitable design or configuration without deviating from the scope of the subject invention. A table 26 surrounds and supports the sewing machine assembly 10 and the trim cover material 18 during operation.

Figure 2:
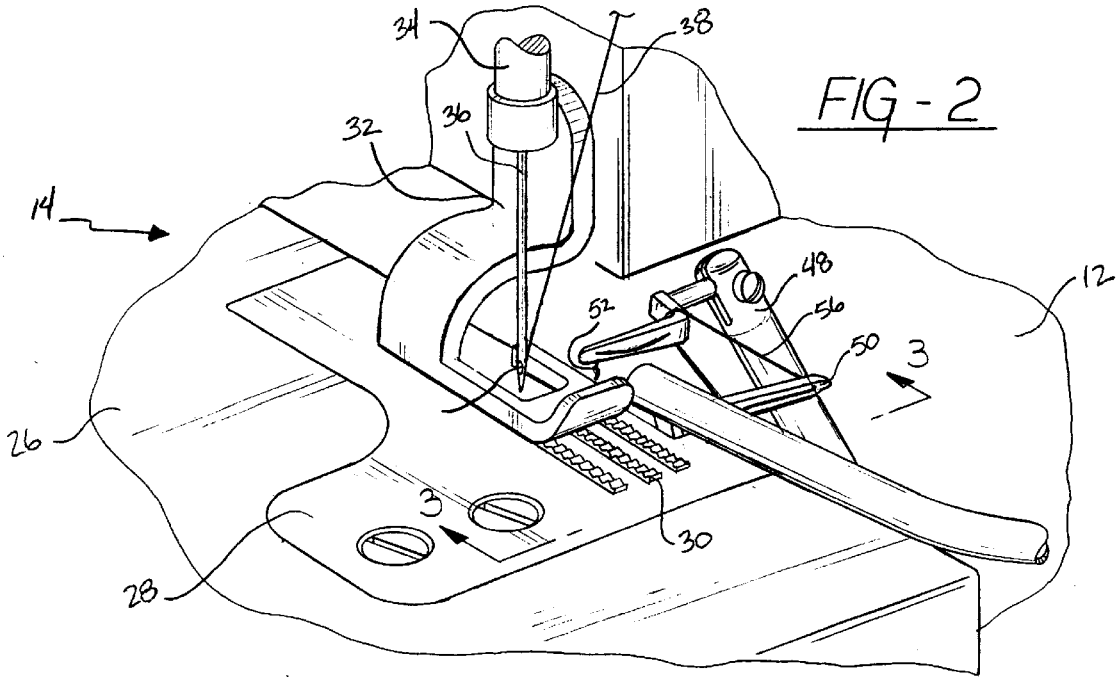
FIG. 2 is an exploded view of a stitching mechanism of the sewing machine assembly of FIG. 1.

Referring also to FIG. 2, the stitching mechanism 14 is shown in greater detail. For illustrative purposes, the cord 16 and trim cover 18 are not shown in this Figure. A stationary support plate 28 is mounted substantially horizontal to the exterior housing 12 for supporting the trim cover 18 thereon. A moveable feed dog 30 is disposed within the support plate 28 to assist in the movement of the trim cover 18. Both the feed dog 30 and support plate 28 are mounted within the table 26 surrounding the sewing machine assembly 10. A presser foot 32 is mounted above the feed dog 30 for sandwiching the trim cover 18 between the presser foot 32 and the feed dog 30. A moveable needle bar 34 is mounted above the support plate 28 for substantially vertical actuation by a motor (not shown). A needle 36 is secured to the needle bar 34 for selective movement through an opening in the presser foot 32, the support plate 28 and the feed dog 30. As appreciated by those skilled in the art, this type of sewing machine design is well known and may be of a slightly different design without deviating from the scope of the subject invention.

A continuous stitching material 38 is drawn from a thread spool 40 into a guide bar 42. The stitching material 38 then passes through a number of other guides (not shown) and then through the needle 36. The stitching material 38 is a continuous nylon thread which is commercially available from American & Efird, Inc. of Mount Holly, N.C. However, any suitable material, such as cotton thread, having adequate strength characteristics could be used without deviating from the scope of the subject invention.

Figure 7:
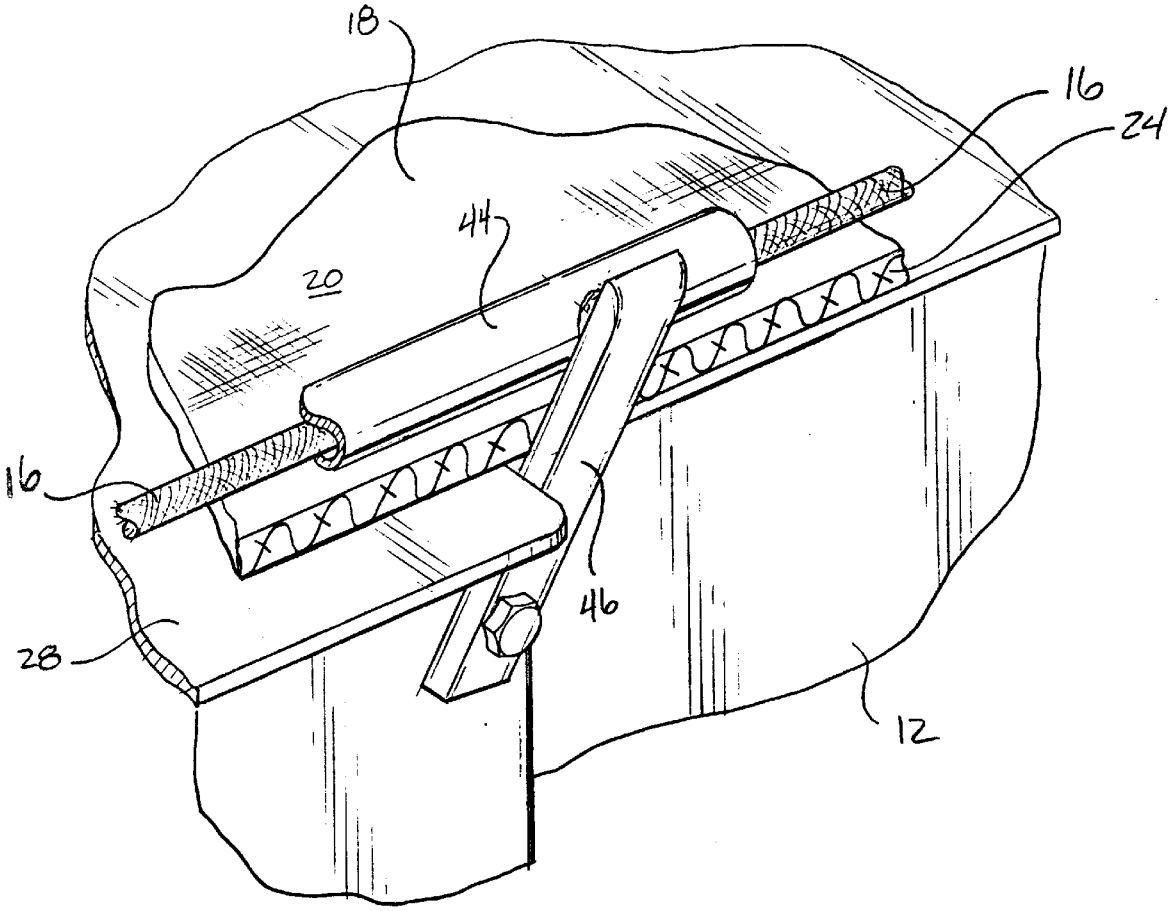
FIG. 7 is partially cross-sectional perspective view taken along line 7—7 of FIG. 1.

Referring also to FIG. 7, a hollow guide member 44 is fixedly secured to the exterior housing 12 and extends substantially parallel to and above the support plate 28 for guiding the drawstring cord 16 along the top surface 20 of the trim cover 18. In the preferred embodiment, the guide member 44 is a hollow tube of a sufficient diameter to allow the cord 16 to pass therethrough. The guide member 44 is disposed inwardly between the housing 12 and the needle 36. Specifically, the guide member 44 includes a flange 46 which acts as a mounting bracket and a guide surface for the trim cover 18.

Figure 4:
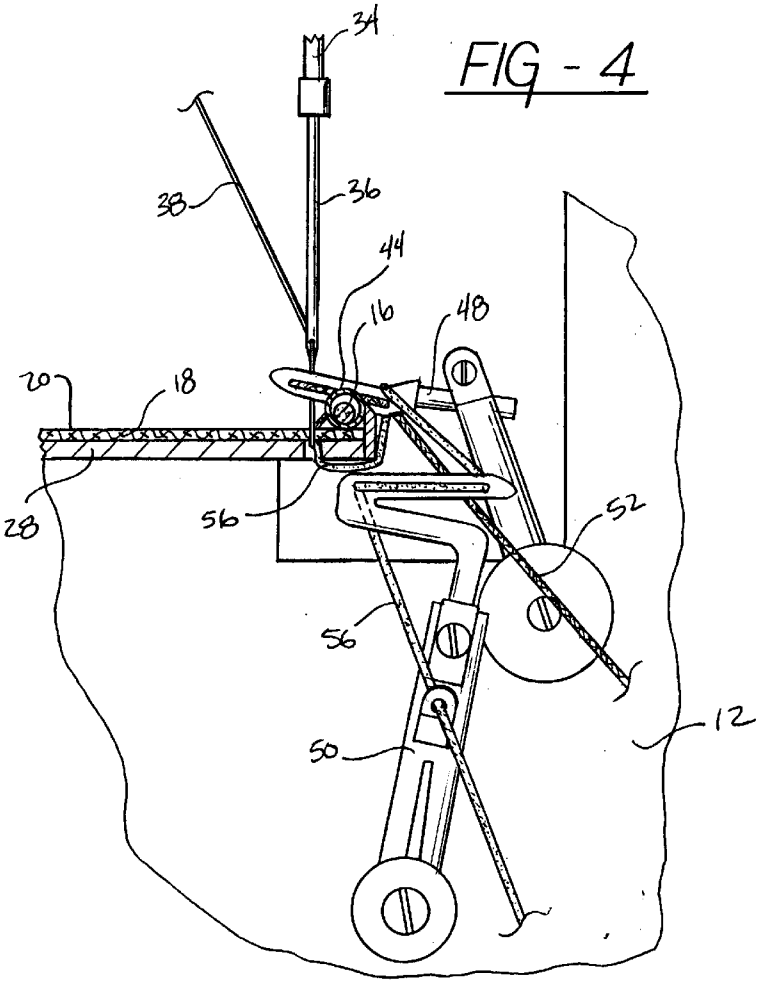
FIG. 4 is a partially cross-sectional side view similar to the view of FIG. 3.
Figure 3:
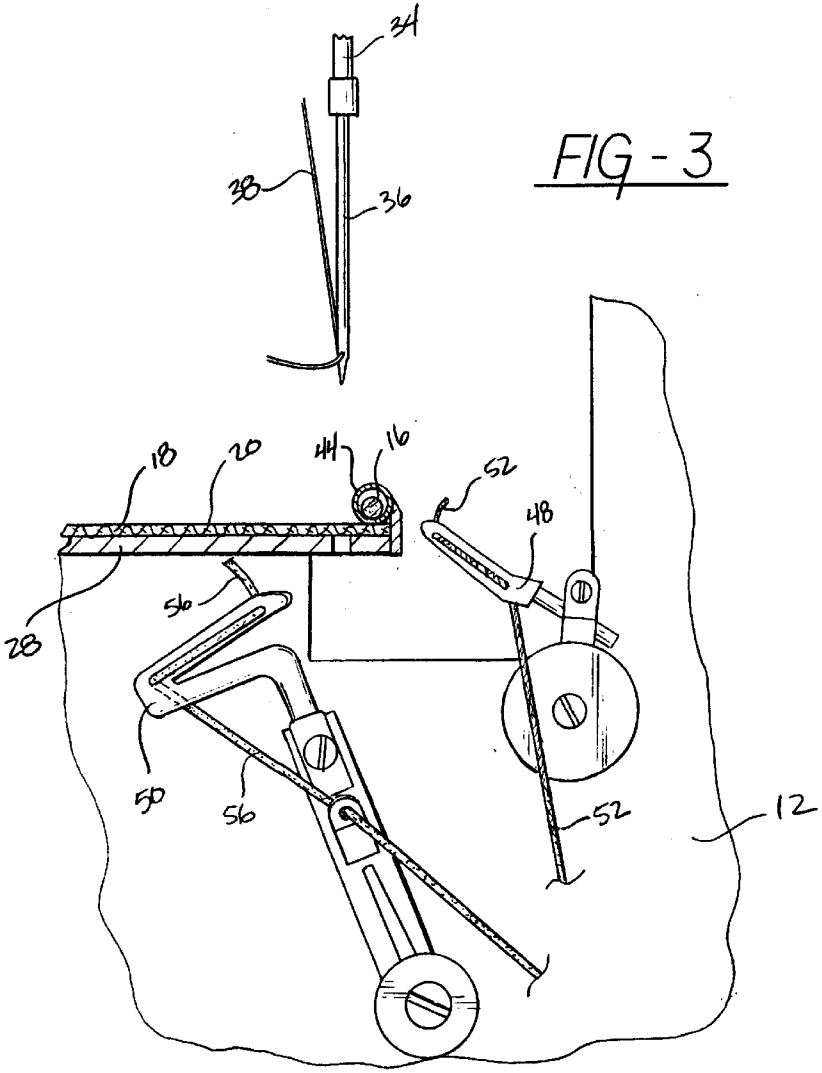
FIG. 3 is a partially cross-sectional side view taken along line 3—3 of FIG. 2.

Referring also to FIGS. 3 and 4, a first looper arm 48 is pivotally mounted to the housing 12 for selective movement above the support plate 28. A second looper arm 50 is also pivotally mounted to the housing 12 for selective movement below the support plate 28. The guide member 44 is disposed between the first 48 and second 50 looper arms for guiding the cord 16 between the first 48 and second 50 looper arms. For illustrative purposes, the flange 46 is not shown extending from the guide member 44.

A plurality of interwoven first strands form a continuous first enclosure material 52 which is drawn from a first yarn spool 54 into the guide bar 42. The first enclosure material 52 then passes through a number of guides (not shown) and into the first looper arm 48. Similarly, a plurality of interwoven second strands form a continuous second enclosure material 56 which is drawn from a second yarn spool 58 into the guide bar 42. The second enclosure material 56 then passes through a number of guides (not shown) and into the second looper arm 50. The first 52 and second 56 enclosure materials are substantially the same. In the preferred embodiment, the enclosure materials 52, 56 are tightly woven coated acrylic yarns. The specific acrylic yarn disclosed is sold under the tradename SUPERTEX T-105 by American & Efird, Inc. of Mount Holly, N.C. This acrylic yarn is made from continuous strands of polyester having a silicone coating to provide added lubrication. As appreciated by those skilled in the art, other suitable materials, such as cotton yarn, could be utilized without deviating from the scope of the subject invention.

As also appreciated by those skilled in the art, numerous additional components necessary to the proper operation of the sewing machine assembly 10 are not disclosed. These additional components are not positively set forth in the appending claims and do not form any part of the inventive components of the subject invention.

Figure 5:
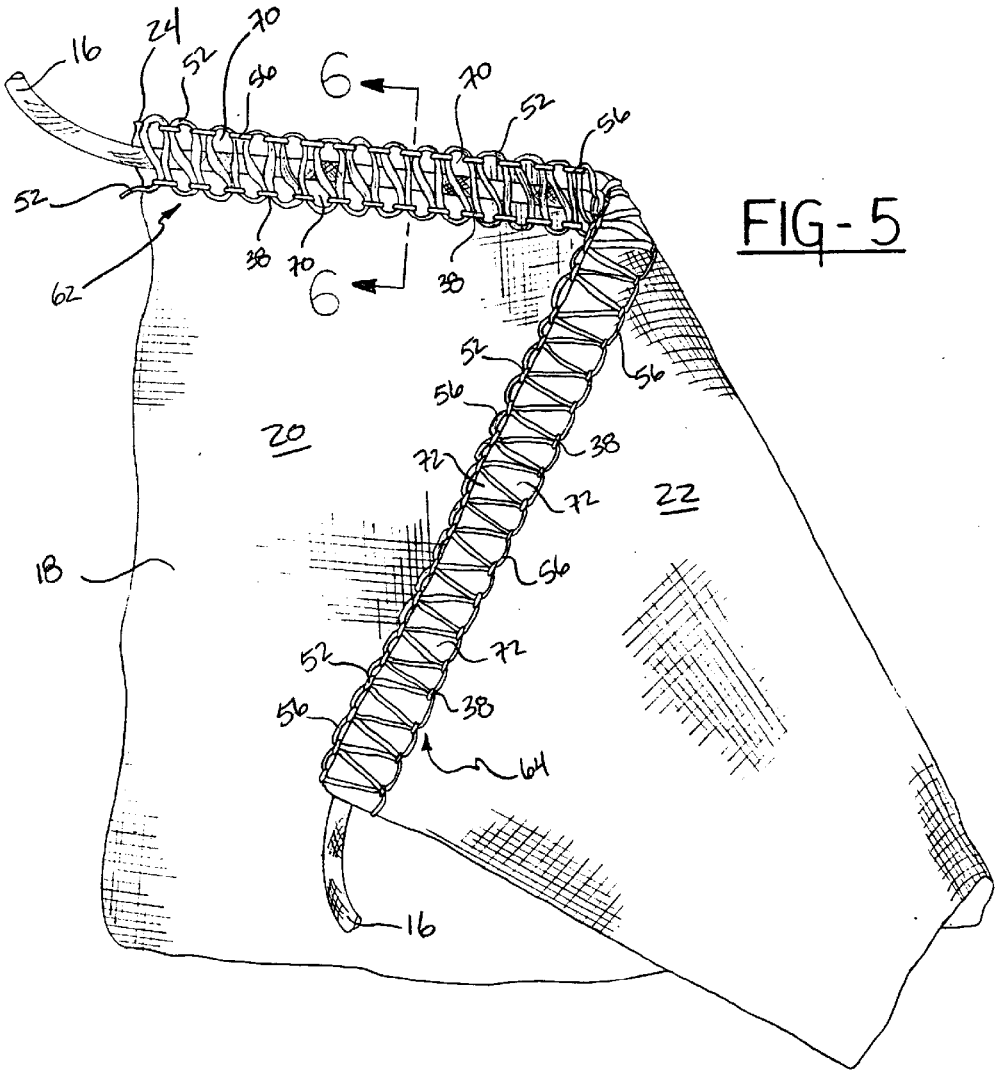
FIG. 5 is a perspective view of a trim cover material incorporating the subject invention.
Figure 6:
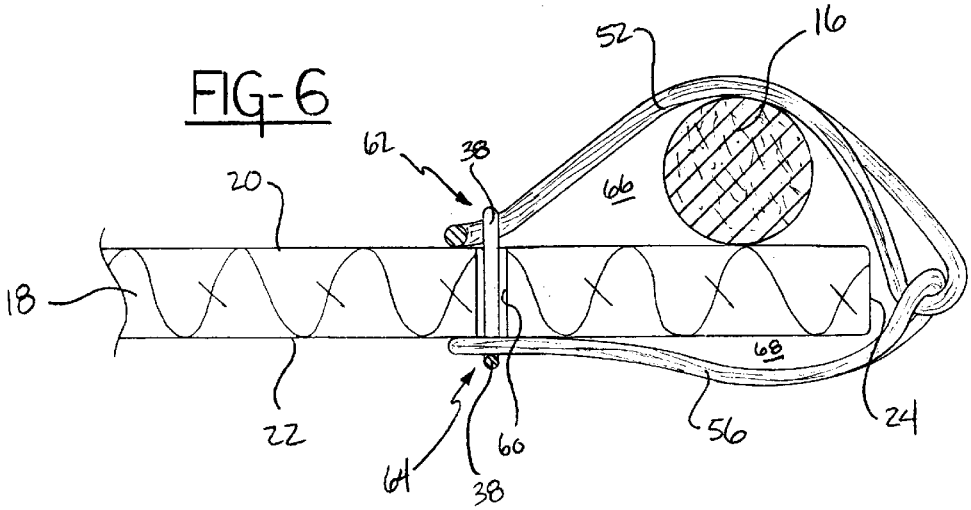
FIG. 6 is an exploded cross-sectional view taken along line 6—6 of FIG. 5

Referring also to FIGS. 5 and 6, the trim cover 18 with the drawstring cord 16 slidably secured thereto is shown in greater detail. A plurality of spaced apart apertures 60 extend through the top 20 and bottom 22 surfaces near the edge portion 24 of the trim cover 18. The apertures 60 are created by piercing the needle 36 through the top 20 and bottom 22 surfaces of the trim cover 18. For illustrative purposes, aperture 60 is shown as a large cavity. In actual practice the apertures 60 are relatively small cavities just slightly larger than the stitching material 38 itself. The continuous stitching material 38 passes through each of these apertures 60 along the entire length of the trim cover 18. The stitching material 38 also passes between each of the apertures 60 along the top surface 20 and the bottom surface 22. Specifically, the stitching material 38 passes into the aperture 60, out of the aperture 60, and then abuts at least a portion of the top surface 20 of the trim cover 18 between the spaced apart apertures 60 to form a first seam generally shown at 62. Similarly, the stitching material 38 passes into the aperture 60, out of the aperture 60, and then abuts at least a portion of the bottom surface 22 of the trim cover 18 between the spaced apart apertures 60 to form a second seam generally shown at 64.

The stitching material 38 passing along the top surface 20 loops around the first enclosure material 52 to pull the first enclosure material 52 against the top surface 20 along the first seam 62. Similarly, the stitching material 38 passing along the bottom surface 22 loops around the second enclosure material 56 to pull the second enclosure material 56 against the bottom surface 22 along the second seam 64.

The first enclosure material 52 loops around the second enclosure material 56 adjacent the edge portion 24 of the trim cover 18 to form a first channel 66 between the edge portion 24 and the first seam 62 along the top surface 20. Similarly, a second channel 68 is formed between the edge portion 24 and the second seam 64 along the bottom surface 22. For illustrative purposes, the first 52 and second 56 enclosure materials are shown spaced apart and loosely attached to the trim cover 18. In actual practice the first enclosure material 52 tightly overlays the cord 16 and the edge portion 24 and the second enclosure material 56 tightly overlays the bottom surface 22 and edge portion 24 of the trim cover 18.

The cord 16 is slidably disposed within at least one of the first 66 and second 68 channels for passing the cord 16 along at least one of the top 20 and bottom 22 surfaces of the trim cover 18. In the preferred embodiment, the cord 16 is slidably disposed within the first channel 66 for passing the cord 16 along the top surface 20 of the trim cover 18. As discussed above, this top surface 20 is actually the interior surface of the trim cover 18.

The first channel 66 includes the first enclosure material 52 weaving at spaced apart intervals between the edge portion 24 and the first seam 62 to form openings 70 within the first channel 66. Similarly, the second channel 68 includes the second enclosure material 56 weaving at spaced apart intervals between the edge portion 24 and the second seam 64 to form openings 72 within the second channel 68. These openings 70, 72 significantly reduce the amount of frictional forces between the enclosure materials 52, 56, trim cover 18 and the cord 16. Hence, a user can easily slide the cord 16 within the first channel 66. As appreciated by those skilled in the art, the first 52 and second 56 enclosure materials may be sewn in a different configuration for forming the first 66 and second 68 channels without deviating from the overall scope of the subject invention.

During operation, the trim cover 18 is fed between the presser foot 32 and the feed dog 30 and support plate 28. The cord 16 is overlaid longitudinally along the top surface 20 of the trim cover 18 near the edge portion 24. The needle 36 is initially in an upwardly retracted position with the first looper arm 48 disposed directly under the needle 36 as shown in FIG. 4. The second looper arm 50 has pivoted to its far right position. The needle 36, which is carrying the first stitching material 38, is lowered and passes between the first looper arm 48 and the first enclosure material 52 to loop the stitching material 38 around the first enclosure material 52. The needle 36 then continues through the presser foot 32, the trim cover 18, and the feed dog 30. As the needle 36 continues downwardly the first looper arm 48 retracts away from the needle 36. This retraction of the first looper arm 48 pulls the first enclosure material 52 downward against the cord 16. The stitching material 38 also tightens against the first enclosure material 52 and the top surface 20 of the trim cover 18.

The second looper arm 50 pivots to the left to draw more of the second enclosure material 56 from the second yarn spool 58. The needle 36 then passes between the second looper arm 50 and the second enclosure material 56 to loop the stitching material 38 around the second enclosure material 56. Simultaneously, the movement of the second looper arm 50 pulls the second enclosure material 56 against the bottom surface 22 of the trim cover 18. During the engagement of the needle 36 with the trim cover 18, the presser foot 32 presses against the trim cover 18 to hold the trim cover 18 in place.

As the needle 36 begins to retract, the second looper arm 50 moves to the right. The first looper arm 48 then passes between the second looper arm 50 and the second enclosure material 56 to loop the first enclosure material 52 around the second enclosure material 56. The stitching material 38 has also tightened against the second enclosure material 56 and the bottom surface 22 of the trim cover 18. The second looper arm 50 is to the far right position just before the first looper arm 48 has returned to its original position directly below the needle 36.

The trim cover 18 then advances along a longitudinal path and the needle 36 begins to lower again to repeat the above described operation. During this continuously synchronous movement of the needle 36, feed dog 30, and the trim cover 18, the stitching material 38 and the first 52 and second 56 enclosure materials are continuously fed from their respective spools 54, 58. In addition, the cord 16 is continuously fed along the top surface 20 of the trim cover 18. The method of manufacturing the subject invention is discussed hereinbelow.

A method of slidably retaining the cord 16 against the trim cover 18 utilizing the continuous stitching material 38 and the plurality of interwoven first and second strands defining continuous first 52 and second 56 enclosure materials is outlined hereinbelow. The method comprises the steps of: forming at least one seam 62, 64 along a respective surface 20, 22 of the trim cover 18 by feeding the continuous stitching material 38 through and between the apertures 60 in the trim cover 18; forming at least one channel 66, 68 between the respective seam 62, 64 and the edge portion 24 of the trim cover 18 by looping the first enclosure material 52 around the second enclosure material 56 adjacent the edge portion 24 of the trim cover 18; overlaying the cord 16 against a portion of the respective surface 20, 22 of the trim cover 18 within the respective channel 66, 68; and looping the stitching material 38 around the first 52 and second 56 enclosure materials to pull at least one of the first 52 and second 56 enclosure materials against the cord 16 and the trim cover 18 for slidably retaining the cord 16 within the respective channel 66, 68 and against the trim cover 18. As discussed above, in the preferred embodiment, the cord 16 is slidably retained within the first channel 66 by the first enclosure material 52 along the top surface 20 of the trim cover 18.

The overlaying of the cord 16 along the top surface 20 of the trim cover 18 is further defined by extending the cord 16 longitudinally along the edge portion 24 of the trim cover 18 before the looping of the stitching material 38 around the first 52 and second 56 enclosure materials.

The forming of the respective channel 66, 68 is further defined by weaving at least one of the first 52 and second 56 enclosure materials along spaced apart intervals between the respective seam 62, 64 and the edge portion 24. The weaving is further defined by forming the respective openings 70, 72 within the respective channel 66, 68.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described.

What is claimed is:

1. An automotive seat assembly comprising:

a trim cover material having a top surface and a bottom surface, said trim cover material having a peripheral edge portion extending along one side thereof, a plurality of interwoven first strands forming a continuous first enclosure material, a plurality of interwoven second strands forming a continuous second enclosure material, a plurality of spaced apart apertures extending through said top and bottom surfaces near said edge portion of said trim cover material, a continuous stitching material passing through each of said apertures, said stitching material passing between each of said apertures along said top surface and looping around said first enclosure material to pull said first enclosure material against said top surface to form a first seam, said stitching material passing between each of said apertures along said bottom surface and looping around said second enclosure material to pull said second enclosure material against said bottom surface to form a second seam, said first enclosure material looping around said second enclosure material adjacent said edge portion of said trim cover material to form a first channel between said edge and said first seam along said top surface and a second channel between said edge and said second seam along said bottom surface, and a cord slidably disposed within at least one of said first and second channels for passing said cord along at least one of said top and bottom surfaces of said trim cover material, wherein said first and second enclosure materials are treated with a material to provide lubrication when in contact with said cord, said first and second enclosing materials, as treated, having a different lubrication property than said stitching material.

2. An assembly as set forth in claim 1 wherein said stitching material abuts at least a portion of said top surface of said trim cover between said apertures along said first seam.

3. An assembly as set forth in claim 2 wherein said stitching material abuts at least a portion of said bottom surface of said trim cover material between said apertures along said second seam.

4. An assembly as set forth in claim 3 wherein said cord is slidably disposed within said first channel for passing said cord along said top surface of said trim cover material.

5. An assembly as set forth in claim 3 wherein said first channel includes said first enclosure material weaving at spaced apart intervals between said edge portion and said first seam to form openings within said first channel.

6. An assembly as set forth in claim 3 wherein said second channel includes said second enclosure material weaving at spaced apart intervals between said edge portion and said second seam to form openings within said second channel.

7. An assembly as set forth in claim 1 wherein said stitching material is a continuous nylon thread.

8. An assembly as set forth in claim 1 wherein said first and second enclosure materials are coated acrylic yarn.

9. An assembly as set forth in claim 1 wherein said first and second enclosure materials are cotton yarn.

10. A method of slidably retaining a cord against a trim cover material having an outer surface comprising the steps of:

providing a continuous stitching material;

providing a plurality of interwoven first and second strands defining continuous first and second enclosure materials, respectively, said first and second enclosure materials having a different lubrication characteristic than the stitching material for providing lubrication when in contact with the cord;

forming at least one seam along the surface of the trim cover by feeding the continuous stitching material through and between a plurality of apertures in the trim cover;

forming at least one channel between the seam and an edge portion of the trim cover by looping the first enclosure material around the second enclosure material adjacent the edge portion of the trim cover;

overlaying the cord against a portion of the surface of the trim cover within the at least one channel; and looping the stitching material around the first and second enclosure materials to pull at least one of the first an second enclosure materials against the cord and the trim cover for slidably retaining the cord within the at least one channel and against the trim cover.

11. A method as set forth in claim 10 wherein the overlaying of the cord along the surface of the trim cover material is further defined by extending the cord longitudinally along the edge portion of the trim cover before the looping of the stitching material around the first and second enclosure materials.

12. A method as set forth in claim 10 wherein the forming of the channel is further defined by weaving at least one of the first and second enclosure materials along spaced apart intervals between the seam and the edge portion.

13. A method as set forth in claim 12 wherein the weaving of at least one of the first and second enclosure materials is further defined by forming openings within the channel.

14. A sewing machine assembly for slidably securing a cord to a trim cover material, said assembly comprising:

an exterior housing, a stationary support plate mounted substantially horizontal to said housing for supporting the trim cover material thereon, a moveable feed dog disposed within said support plate, a moveable needle bar mounted above said support plate for substantially vertical actuation by a motor, a needle secured to said needle bar for selective movement through said support plate and said feed dog, a stitching material passing through said needle, a first looper arm pivotally mounted to said housing for selective movement above said support plate, a plurality of interwoven first strands forming a first enclosure material passing through said first looper arm, a second looper arm pivotally mounted to said housing for selective movement below said support plate, a plurality of interwoven second strands forming a second enclosure material passing through said second looper arm, and a hollow guide member fixedly secured to said housing and extending substantially parallel to and above said support plate for guiding said cord between said first and second looper arms, wherein said first and second enclosure materials are made of a material having a different lubrication property than said stitching material.

15. An assembly as set forth in claim 14 wherein said guide member is a hollow tube.

16. An assembly as set forth in claim 14 wherein said guide member is disposed inwardly between said housing and said needle.

17. An assembly as set forth in claim 14 wherein said first and second enclosure materials are coated acrylic yarn.

18. An assembly as set forth in claim 14 wherein said first and second enclosure materials are cotton yarn.

19. An assembly as set forth in claim 14 wherein said stitching material is a continuous nylon thread.

20. An automotive seat assembly, comprising:

a trim cover material having a top surface and a bottom surface;

said trim cover material having a peripheral edge portion extending along one side thereof;

a plurality of interwoven first strands forming a continuous first enclosure material;

a plurality of interwoven second strands forming a continuous second enclosure material;

a plurality of spaced apart apertures extending through said top and bottom surfaces near said edge portion of said trim cover material;

a continuous stitching material passing through each of said apertures;

said stitching material passing between each of said apertures along said top surface and looping around said first enclosure material to pull said first enclosure material against said top surface to form a first seam;

said stitching material passing between each of said apertures along said bottom surface and looping around said second enclosure material to pull said second enclosure material against said bottom surface to form a second seam;

said first enclosure material looping around said second enclosure material adjacent said edge portion of said trim cover to form a first channel between said edge and said first seam along said top surface and a second channel between said edge and said second seam along said bottom surface; and a cord slidably disposed within at least one of said first and second channels for passing said cord along at least one of said top and bottom surfaces of said trim cover, wherein said first and second enclosure materials are made of a material having a different lubrication characteristic than said stitching material.

* * * * *